US009441186B2

(12) United States Patent
Cagle et al.

(10) Patent No.: US 9,441,186 B2
(45) Date of Patent: Sep. 13, 2016

(54) SYSTEM AND METHOD FOR MANUFACTURING A CANDLE WITH WAX BEADS AND SOLID WAX TOPPING

(75) Inventors: John E. Cagle, Greenfield, MA (US); Robert W. Brown, Palmer, MA (US); Michael P. Patterson, South Deerfield, MA (US)

(73) Assignee: The Yankee Candle Company, Inc., South Deerfield, MA (US)

( * ) Notice: Subject to any disclaimer, the term of this patent is extended or adjusted under 35 U.S.C. 154(b) by 562 days.

(21) Appl. No.: 13/311,143

(22) Filed: Dec. 5, 2011

(65) Prior Publication Data

US 2012/0137634 A1 Jun. 7, 2012

Related U.S. Application Data

(60) Provisional application No. 61/419,407, filed on Dec. 3, 2010.

(51) Int. Cl.
*C11C 5/02* (2006.01)
*C11C 5/00* (2006.01)

(52) U.S. Cl.
CPC ..... *C11C 5/021* (2013.01); *C11C 5/008* (2013.01)

(58) Field of Classification Search
CPC ..... C11C 5/021
USPC ..... 425/803
See application file for complete search history.

(56) References Cited

U.S. PATENT DOCUMENTS 2,697,926 A * 12/1954 Knox, Jr. ..... 431/288
2,978,231 A * 4/1961 Eisenberg ..... 366/109
3,002,221 A * 10/1961 Wright ..... 264/112
3,702,495 A * 11/1972 Renoe ..... 29/428
4,017,231 A 4/1977 Karlsson
4,614,625 A * 9/1986 Wilson ..... 264/6
6,151,767 A * 11/2000 Gross ..... 264/330
7,736,145 B1 * 6/2010 Horvath et al. ..... 264/247
2003/0134246 A1 7/2003 Gray et al.
2004/0188436 A1 * 9/2004 Mladenovic ..... 220/23.87
2005/0037308 A1 * 2/2005 Decker ..... 431/325
2007/0144058 A1 * 6/2007 Chen et al. ..... 44/275
2007/0169404 A1 * 7/2007 Cagle ..... 44/275
2010/0132250 A1 6/2010 Uptain et al.
2010/0327020 A1 * 12/2010 Higuchi et al. ..... 222/241
2011/0300496 A1 * 12/2011 Cagle ..... C11C 5/002 264/8

OTHER PUBLICATIONS

International Search Report issued for PCT/US11/63288, dated Apr. 19, 2012 (1 page).

* cited by examiner

*Primary Examiner* — Alison L Hindenlang
(74) *Attorney, Agent, or Firm* — Wilmer Cutler Pickering Hale and Dorr LLP

(57) ABSTRACT

The candle uses wax beads produced using existing equipment. The wax beads are transported to a bead hopper and the bead hopper deposits a volume of wax beads into jars prepared with a wick. Concurrently the jars are vibrated using a continuous vibratory motor to settle the wax beads for increased wax bead density. The filled jars are then transported to an in-container wax bead compression system where an automated plunging device compresses the wax beads. Jars are then transported by in-line conveyor to a wide conveyor. The jars are then filled at a liquid wax depositing station where the wax has been heated to its melting point and deposited into the jar to fill the void left by the in-container wax bead Compression system. The filled candle is then cooled to solidification. The finished candle is then ready for packing, distribution, sale, and use.

7 Claims, 6 Drawing Sheets

SYSTEM AND METHOD FOR MANUFACTURING A CANDLE WITH WAX BEADS AND SOLID WAX TOPPING

CROSS REFERENCE TO RELATED APPLICATION

This application claims priority to U.S. Provisional Application No. 61/419,407, filed on Dec. 3, 2010, which is incorporated herein by reference.

BACKGROUND OF THE INVENTION

The present invention relates to scented wax candles and more particularly to a system and process for manufacturing a scented candle made of scented wax beads and covered with a solid wax topping.

Scented candles are a popular fixture in many homes. Generally, candles consist of one or more solid wax components, with one or more fragrances. Of some increasing popularity are candles made of small beads of scented wax, to be assembled in a vessel by the end user, marketed as do-it-yourself kits.

While candles made from beads of wax have many benefits, they can also present some practical difficulties. First, most of the currently marketed wax bead candles are only available as do-it-yourself kits, where the beads are shipped and available for purchase separately from the container and the wick. The consumer has the benefit of being able to choose the container apart from the wax portion, but the consumer must also assemble the candle. Filling a container with thousands of small beads while keeping the wick in place could be a messy task. In addition, current candles made of wax beads are manufactured one at a time which makes it difficult to mass market such candles.

Of course, the wholesaler or retailer may assemble the candles pre-purchase. In a wax bead candle, however, the wick, which is normally held in a central position in solid wax candles, may shift during transportation and in use because the beads are fluid. The wax beads themselves also may shift during transportation and use, resulting in loss or an uneven appearance. The latter result is especially problematic if different wax bead colors and/or fragrances are layered to provide an aesthetic effect.

The manufacture of such a beaded candle through an automated process poses several obstacles because the beads can shift during shipping thereby greatly changing both the performance and appearance of the candles. There is also a concern that the wick would shift as the volume of beads moves within the jar which could cause uneven burning.

It is a principal object of the present invention to provide a system and method for manufacturing a candle comprised of wax beads that can be packaged and shipped in commercial quantities without significant added cost or processing steps to keep the beads in place.

Another object of the present invention it to provide a system and method for manufacturing a candle comprised of wax beads that maintains the position of the wick in the center of the candle vessel.

Another object of the present invention is to provide a system and method for manufacturing a candle comprised of wax beads that manufactures candles in high volumes.

SUMMARY OF THE INVENTION

The candle is formed by first producing wax beads from existing equipment. The wax beads are transported to a bead hopper and the bead hopper deposits a volume of wax beads into jars prepared with a wick. Concurrently the jars are vibrated using a continuous vibratory motor to settle the wax beads for increased wax bead density. The filled jars are then transported to an in-container wax bead compression system where an automated plunging device compresses the wax beads. Jars are then transported by in-line conveyor to a wide conveyor. The jars are then filled at a liquid wax depositing station where the wax has been heated to its melting point and deposited into the jar to fill the void left by the in-container wax bead compression system. The filled candle is then cooled to solidification. The finished candle is then ready for packing, distribution, sale, and use.

These and other features and objects of the present invention will be more fully understood from the following detailed description which should be read in light of the accompanying drawings in which corresponding reference numerals refer to corresponding parts throughout the several views.

DETAILED DESCRIPTION OF PREFERRED EMBODIMENTS

In the present invention, wax beads 12 are formed using any known processes. In one common process to form wax beads, the wax beads 12 are manufactured by mixing together various combustible waxes or wax-like materials. These materials are mixed and melted into a homogenous liquid state creating a molten "blend". A molten blend is then sprayed into the air via nozzles with an orifice of 0.35 mm to 0.45 mm onto a rotating cold drum where small spheres (approximately 0.25 mm-1.25 mm in diameter) are formed. The small spheres are scraped off the cold drum into a vibrating pan and collected at a point of vacuum. The vacuum delivers small spheres to a filling hopper 14.

Figure 1:
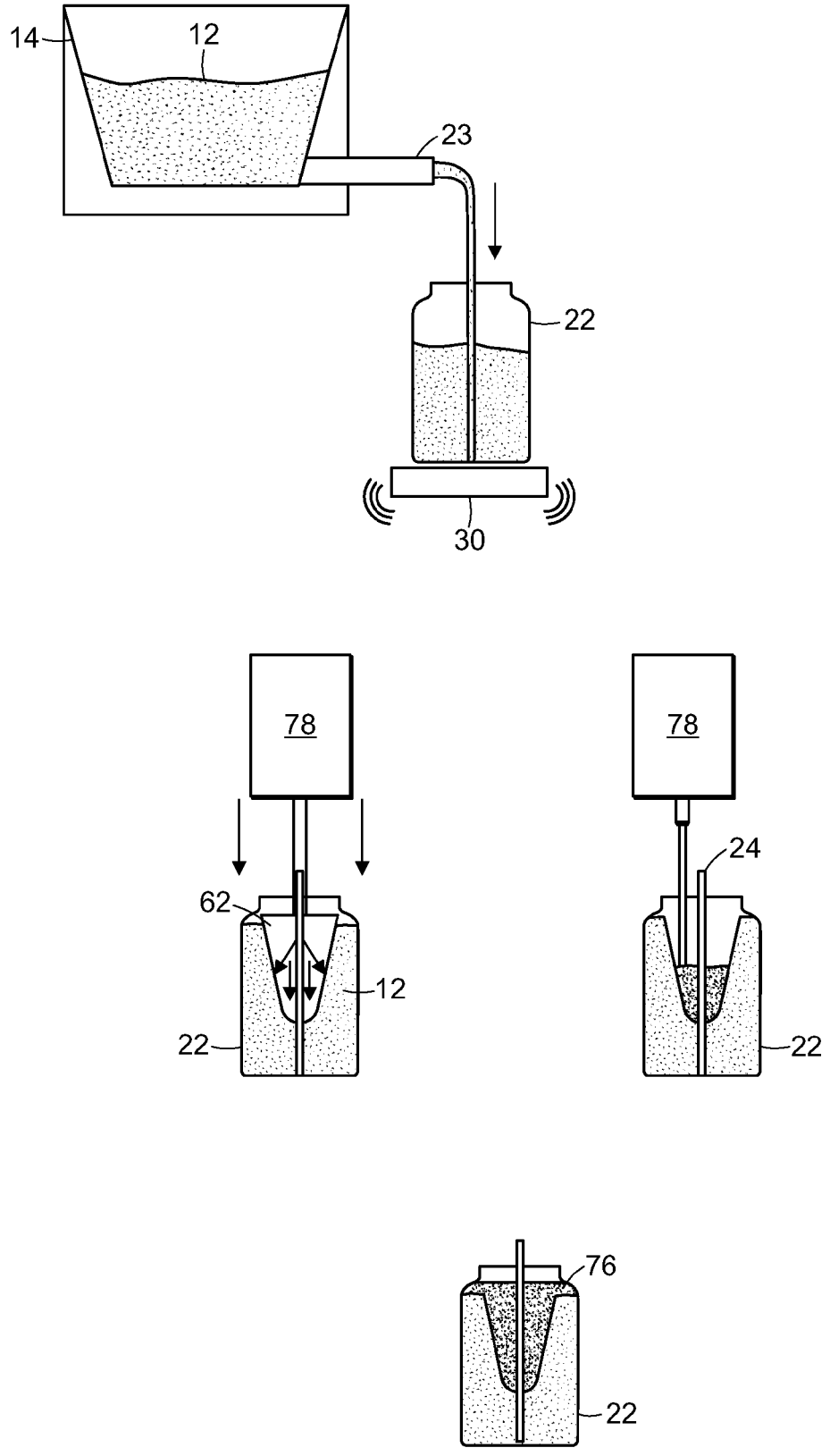
FIG. 1 is a schematic of the process flow of the system and method for manufacturing a candle with wax beads and solid wax topping of the present invention.
Figure 2:
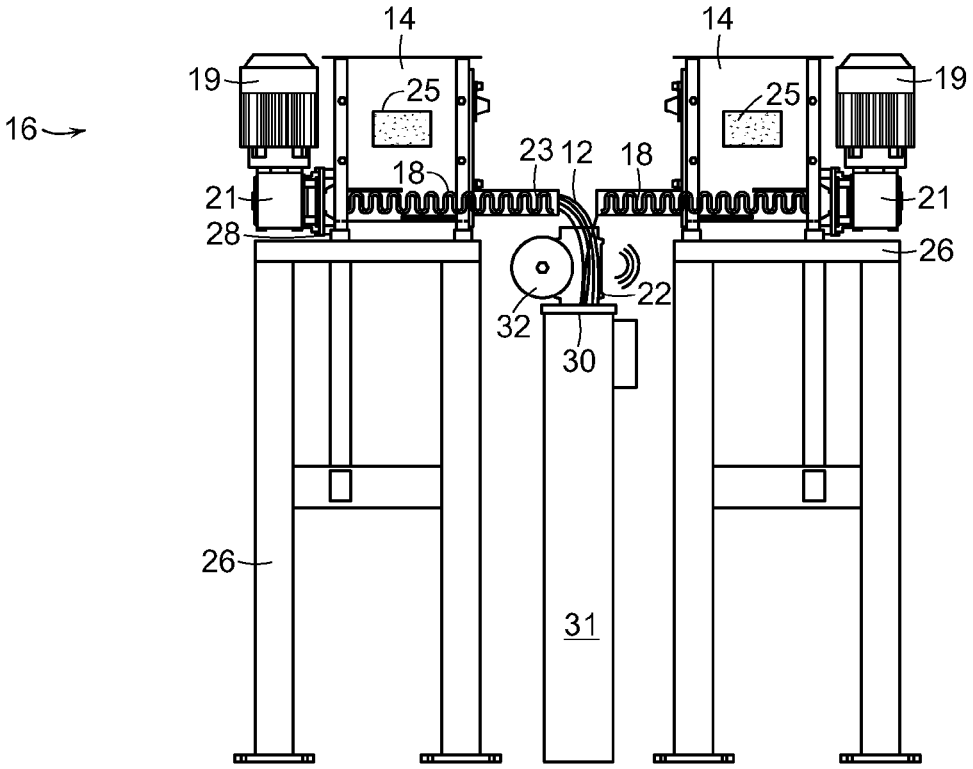
FIG. 2 is an elevational view of the feed hopper dispensing system used in the system for manufacturing a candle of the present invention.
Figure 3:
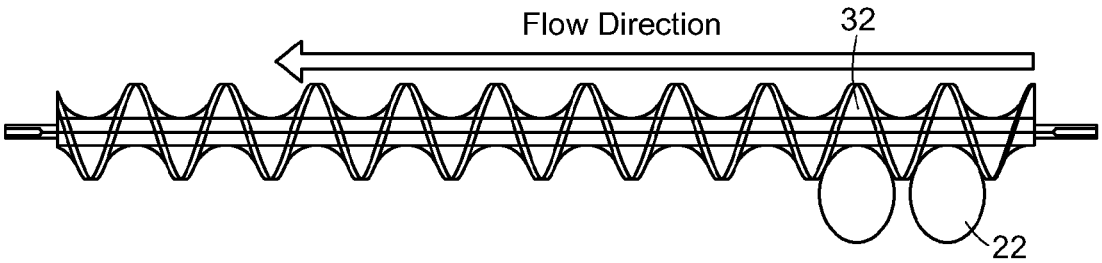
FIG. 3 is side view of the jaw feed screw used in the system of FIG. 2.
Figure 4:
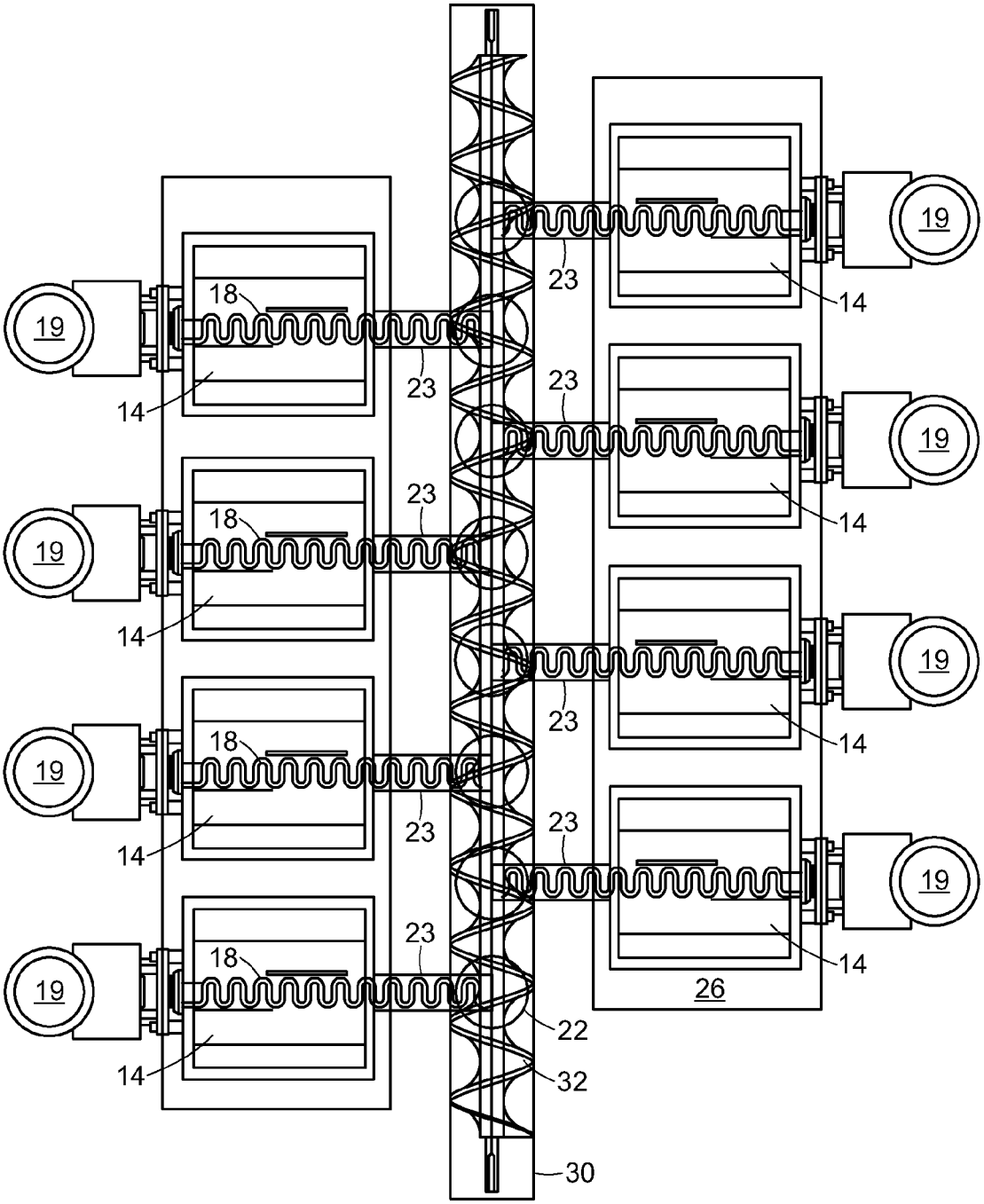
FIG. 4 is a top plan view of an entire system used for manufacturing a candle with wax beads and solid wax topping of the present invention.

Referring to FIGS. 1-4, the wax beads 12 may be transported to a wax bead dispensing system 16 by a variety of methods, but preferable by vacuum. The dispensing system includes a bead hopper 14. A helix screw 18, located at the bottom of the bead hopper 14 and extending through the bead hopper 14, is used to forward or move the wax beads through the delivery tube 23 into a jar 22 prepped with wick 24. The helix screw 18 is powered by an auger motor 19 through auger gear box 21. The amount of wax beads 12 delivered and the speed of delivery are controlled by a programmable logic controller (PLC) (not shown) using a human interface device. Attached to the bead hopper is a pulse vibratory motor 25 used to loosen the wax beads 12 and prevent them from bridging. Bridging is not desired as this phenomenon affects smooth wax bead flow. The bead hopper 14 is mounted to an auger / bead hopper platform 26 by rubber feet 28 to prevent unnecessary vibration transfer to the support structure. Each bead hopper 14 fills one jar 22 at a time. In FIG. 2, two bead hoppers 14 are shown, opposite each other and slightly shifted from one another. In FIG. 4, eight bead hoppers 14 are shown which enable many jars 22 to be filled in line.

An in-line conveyor 30 supported by conveyor stand 31 is used to deliver the jar 22 with prepped wick 24 to a jar feed screw device 32. The jar feed screw device 32 ensures the jars' position is centered relative to the delivery tube 23. During filling, the jars 22 are vibrated in an effort to promote wax bead 12 settling, thus, increasing wax bead density, without the use of external force. Upon fill completion the vibrating conveyor 30 terminates vibration and the filled jars 22 are moved forward by the jar feed screw 32 to the in-container wax bead compression system (ICWBCS) which is described below. The process is then repeated for additional jars.

The ICWBCS is comprised of two subsystems, a wick centering subsystem 42 and a wax bead compression subsystem 60.

Figure 5:
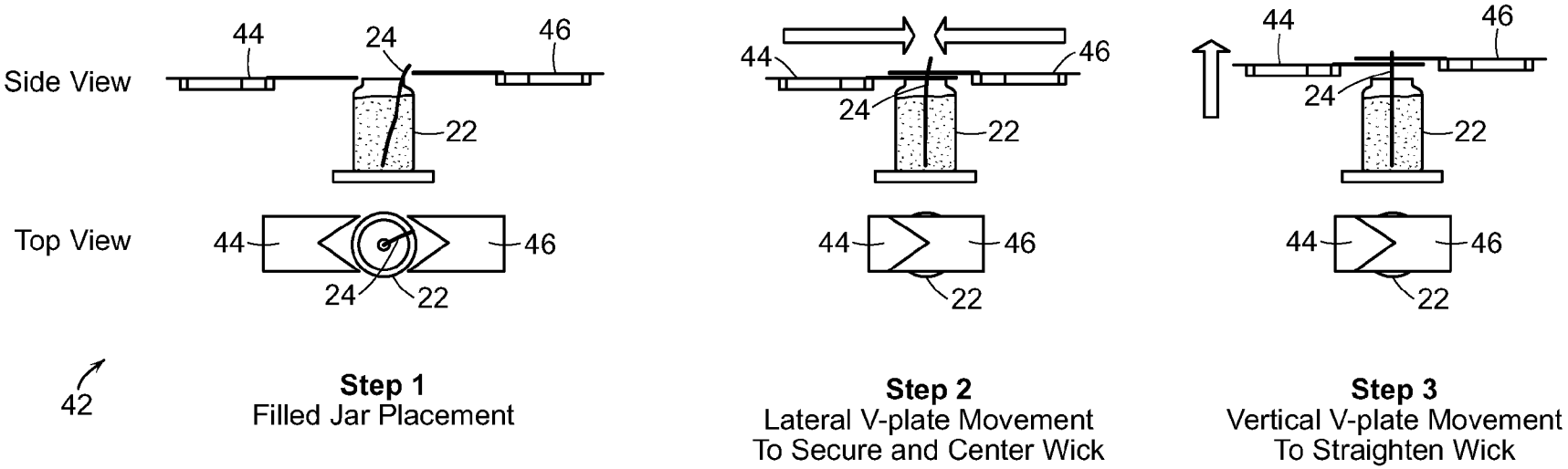
FIG. 5 shows the process for straightening a wick in the system and method for manufacturing a candle of the present invention.

Referring now to FIG. 5, the jar 22, now filled with beads 12, is transported via in-line conveyor 30 to the ICWBCS wick centering subsystem 42. In step 1, the filled jars 22 are locked into position by a feed jar screw 32 . Next in step 2, two v-plates (lower v-plate 44 and upper v-plate 46) move together in a lateral direction such that the wick 24 is "captured" and held at the bottom of each v-plate 44, 46. Both the v-plates 44, 46 and the feed jar screw 32 are critically positioned relative to one another so that the wick 24 is centered. The v-plates 44, 46 then move vertically in an upward direction in an effort to make the wick 24 taught. It is important to the function of the finished candle 10 that the wick 24 be both centered and taught.

Figure 6:
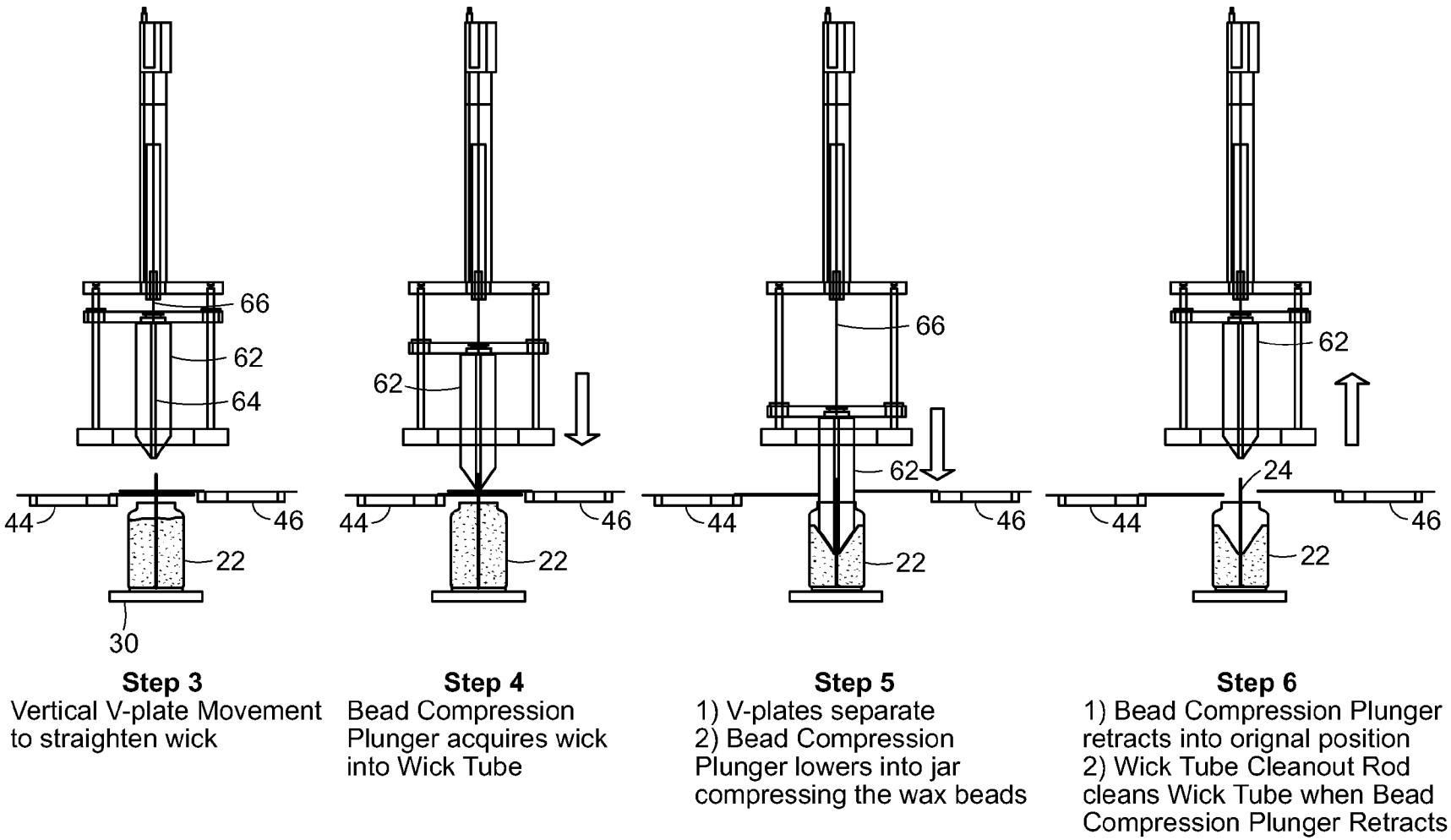
FIG. 6 shows the process for compressing the beads in the system and method for manufacturing a candle of the present invention.

Referring to FIG. 6, after the wick 24 is centered in jar 22, the wax bead plunger 62 of the wax bead compression subsystem 60 moves vertically downward in step 4 and the wick 24 end is threaded into the wick tube 64. Next the compression cycle is performed in step 5 in which the v-plates 44, 46 move apart laterally and the bead compression plunger 62 moves vertically downward. The travel distance of the bead compression plunger 62 is controlled by downward force motor torque using amperage percentage of a full load. The bead compression plunger 62 is held in the downward position for 5 to 15 seconds to maximize bead compression cohesion without excessive force, before the bead compression plunger 62 returns to its original position in step 6. A wick tube cleanout rod 66, located in the wick tube 64 of the bead compression plunger 62, removes any wax beads 12 that may have become lodged in the wick tube 64 during the compression cycle.

Figure 7:
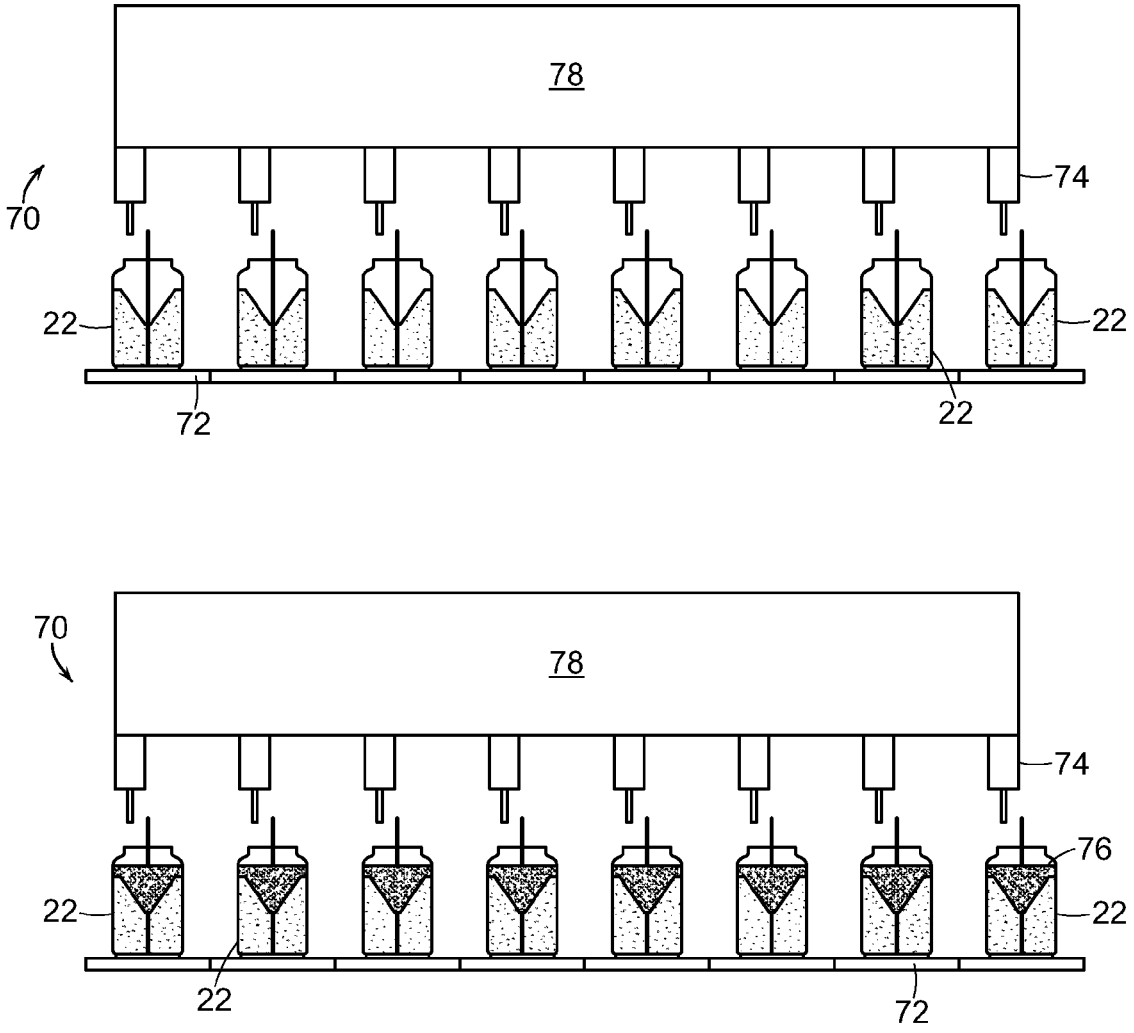
FIG. 7 is a schematic of the steps used to finish the candles manufactured using the system and method of the present invention.

Referring to FIG. 7, the filled jars 22 with compressed wax beads 12 are moved by in-line conveyor 68 to the finishing system 70 from the ICWBCS. Jars 22 are then transported by in-line conveyor to a wide conveyor 72 where they continue to the finishing system 70. The filled jars 22 stop directly under liquid wax dispensing nozzles 74. Liquid wax 76 is dispensed from the wax reservoir 78 to the filled jars 22 with compressed wax beads 12. The amount of liquid wax 76 dispensed is enough to fill the cone-shaped depression in the jars 22. Upon liquid wax filling completion, the jars 22, now topped with wax 76, are left to cool and subsequently solidify. The finished candles are then ready for packing, distribution, sale, and use.

While the foregoing invention has been described with reference to its preferred embodiments, various alterations and modifications will occur to those skilled in the art. All such alterations and modifications are intended to fall within the scope of the appended claims.

What is claimed:

1. A method for manufacturing a wax bead candle comprising the steps of:

inserting a wick in said candle jar;

filling a candle jar with wax beads to form a volume of said wax beads around said wick and in contact with said wick;

straightening and centering said wick in said volume of wax beads after said candle jar is filled with said wax beads;

compressing said volume of said wax beads within the candle jar and around said wick so that a sunken portion is formed in a top surface of said volume of wax beads with said sunken portion having a height around a perimeter of said volume greater than the height of said volume of wax beads in a middle of said volume of wax beads, wherein the heights of the perimeter and middle of said volume being measured from a bottom surface of said candle; and depositing a layer of liquid wax into the sunken portion to cover the entire top surface of said volume of compressed wax beads in the candle jar so that a height of said layer of liquid wax is greater in the middle of said candle jar than the height of said layer of liquid wax around the perimeter of said candle jar, said liquid wax surrounding said wick in contact with said wick.

2. The method for manufacturing a wax bead candle of claim 1 wherein said step of compressing said volume of said wax beads comprises vibrating the candle jar filled with said wax beads before depositing said layer of liquid wax.

3. The method for manufacturing a wax bead candle of claim 1 wherein said step of compressing said volume of said wax beads comprises inserting a conical-shaped plunger into the candle jar to exert a force on said volume of said wax beads to cause said volume of said wax beads to compress and to form said sunken portion.

4. The method for manufacturing a wax bead candle of claim 3, wherein said wick is of sufficient length to extend from a bottom surface of said candle jar to protrude through said volume of said wax beads.

5. The method for manufacturing a wax bead candle of claim 4 further comprising the step of centering said wick in said candle jar while compressing said volume of said wax beads.

6. The method for manufacturing a wax bead candle of claim 4 further comprising the step of maintaining said wick in a taut position in said candle jar while compressing said volume of said wax beads.

7. The method for manufacturing a wax bead candle of claim 3 wherein said step of depositing a layer of liquid wax over said volume of compressed wax beads in the candle jar further comprises the step of filling said sunken portion in said volume of said wax beads with said liquid wax.

* * * * *